United States Patent [19]

Kitt

[11] 4,188,152

[45] Feb. 12, 1980

[54] GRAVEL SPREADER

[76] Inventor: Edward A. Kitt, 1604 - 8th Ave. South, Cranbrook, British Columbia, Canada, V1C 2L4

[21] Appl. No.: 910,983

[22] Filed: May 30, 1978

[51] Int. Cl.[2] ..... E01C 19/20

[52] U.S. Cl. ..... 404/110; 172/452; 37/8

[58] Field of Search ..... 404/104, 118, 120, 108, 404/110, 105; 37/8; 172/452

[56] References Cited

U.S. PATENT DOCUMENTS

| | | | |
|---|---|---|---|
| 2,089,094 | 8/1937 | Kime | 404/104 |
| 2,116,503 | 5/1938 | Arndt | 404/104 |
| 2,794,274 | 6/1957 | Robinson | 404/118 X |
| 2,848,930 | 8/1958 | Thompson | 404/104 |
| 2,989,930 | 6/1961 | Flowers | 404/108 X |
| 3,015,261 | 1/1962 | MacDonald | 404/104 |
| 3,109,351 | 11/1963 | Dunn | 404/104 |
| 3,130,654 | 4/1964 | Apel | 404/105 X |
| 3,216,337 | 11/1965 | MacDonald | 404/104 |
| 3,453,939 | 7/1969 | Pollitz | 404/118 X |
| 3,559,543 | 2/1971 | Schwoebel | 404/118 X |
| 3,636,831 | 1/1972 | Davin | 404/104 X |
| 3,680,451 | 8/1972 | Birtchet | 404/104 |

*Primary Examiner*—Nile C. Byers, Jr.

*Attorney, Agent, or Firm*—Townsend and Townsend

[57] ABSTRACT

An apparatus for spreading loose material, such as gravel, on a surface. The apparatus comprises an elongate material spreader for positioning generally parallel to the surface a distance above the surface. A frame extends forwardly and above the spreader to a pivotal connector for connecting the apparatus to a hopper trailer between the trailer and the surface. A first material retainer extends forwardly from the front of the spreader near one end of the spreader. A second material retainer extends forwardly from the front of the spreader. The first retainer is positionable a distance from the second retainer so that, when the material is distributed from the trailer a distance from the front of the spreader in a forward direction, the material is spread between the first and second retainers and between the bottom edge of the spreader and the surface, as the trailer moves in the forward direction along the surface.

12 Claims, 6 Drawing Figures

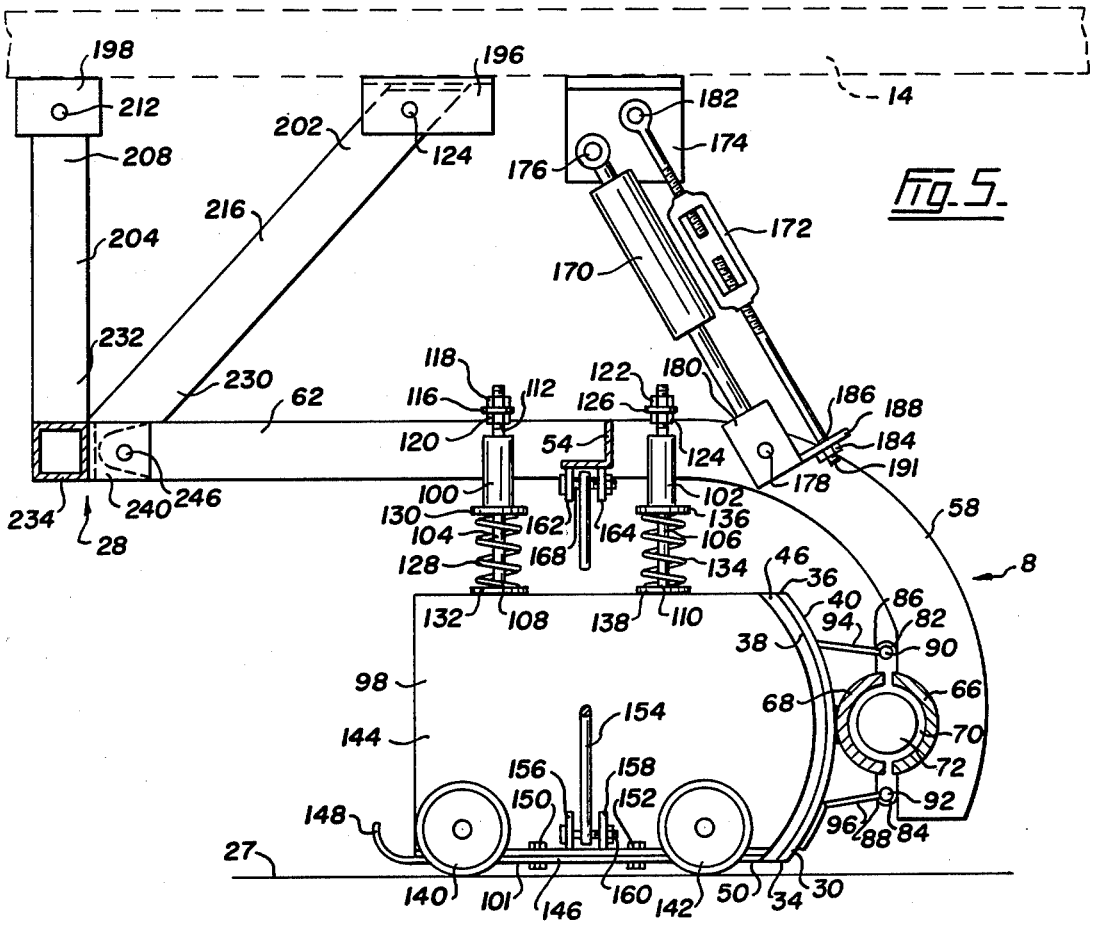
Fig. 5.
Fig. 6.
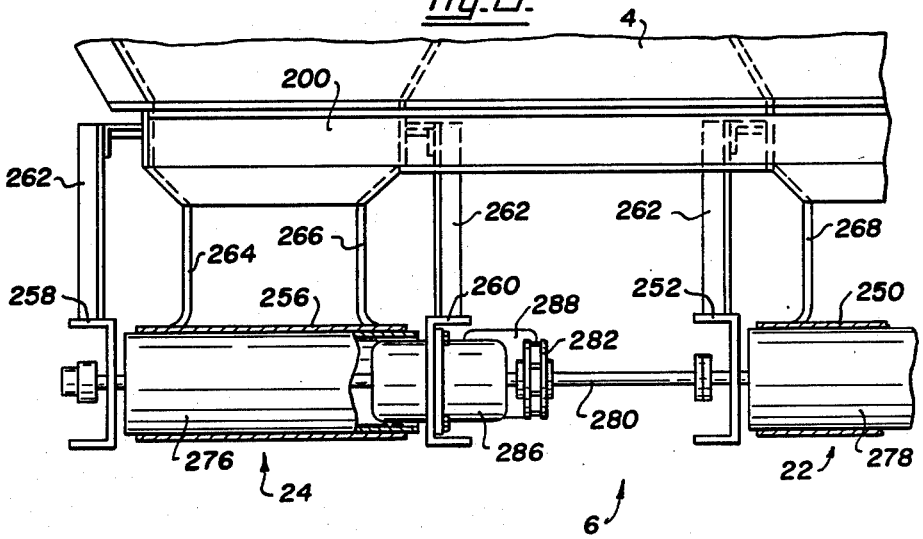

GRAVEL SPREADER

BACKGROUND OF THE INVENTION

This invention relates to an apparatus for spreading loose material on a surface.

Many machines have been suggested in the past for spreading gravel along the shoulders of a paved road. Some machine are entirely adapted for such gravel spreading and are complicated, expensive and inflexible. Other attempts have been made to provide spreaders as attachments for other road building machinery. For example, in U.S. Pat. No. 3,015,261 to MacDonald, a trench filling and shoulder spreading machine is disclosed which operates as an attachment for the front of a road grader. Again, the attachment is quite complicated and expensive and ties up the road grader which could better be used for other tasks.

SUMMARY OF THE INVENTION

According to this invention, there is provided an apparatus for spreading loose material, such as gravel, on at least a portion of a surface. The apparatus comprises an elongate material spreader for positioning generally parallel to the surface a distance above at least a portion of the surface. The spreader has a bottom edge, a top, a front and a back. A frame means extends forwardly and above the spreader to means for pivotally connecting the apparatus to a hopper trailer between the trailer and the surface. First material retaining means is connected to the apparatus and extends generally forwardly from the front of the spreader near a first end of the spreader. Second material retaining means is connected to the apparatus and extends forwardly from the front of the spreader. Means is provided for positioning the first retaining means and the second retaining means a distance apart along the spreader so that, when the material is distributed from the trailer a distance from the front of the spreader in a forward direction, the material is spread between the first and second retaining means and between the bottom edge of the spreader and the surface, as the trailer moves in the forward direction along the surface.

There may also be provided a combination of the apparatus, a hopper trailer having at least one hopper for the material and means for distributing the material to the front of the spreader between the first and second retaining means. The spreader extends laterally outwards from the hopper trailer in an operational position, the second material retaining means being adjacent the trailer and the first material retaining means being spaced from the trailer.

The invention provides many advantages when compared with the prior art. For example, the apparatus is simple, inexpensive and easy to maintain. Moreover, since each tractor and trailer combination can be provided with such an apparatus, a whole line of hauling units are not tied up in the event of a break down, as is the case where a single spreading unit is employed. Additionally, relatively expensive units such as road graders are not tied up spreading gravel on a shoulder of a road, but are freed for other tasks.

In the drawings:

FIG. 5 is a sectional view taken along section 5—5 of FIG. 4 showing the apparatus for spreading loose material and the connections between the apparatus and the trailer shown in FIGS. 1 to 4;

FIG. 6 is an enlarged side elevational view of one belt conveyor shown in FIG. 1 and a portion of the other belt conveyor and showing the drive mechanism of the belt conveyors as taken along section 6—6 of FIG. 4.

DESCRIPTION OF THE PREFERRED EMBODIMENTS

Figure 1:
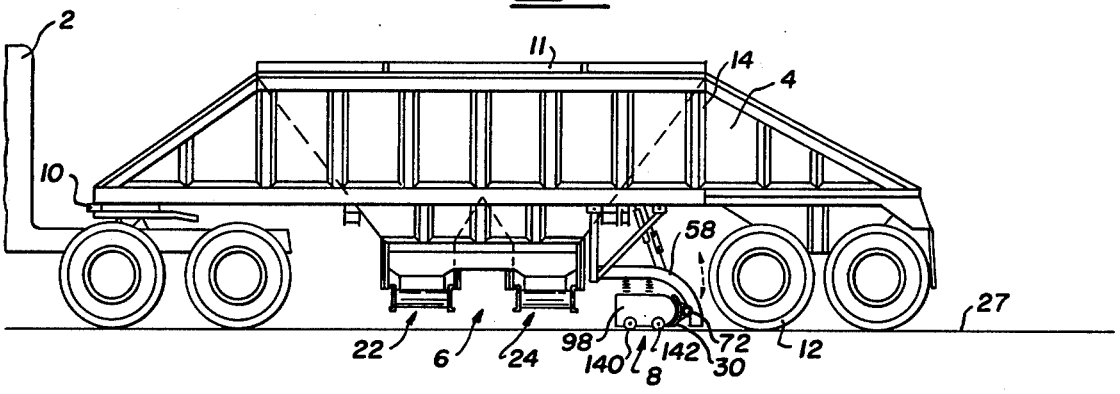
FIG. 1 is a side elevational view of a hopper trailer, a portion of a tractor, a conveyor belt system for distributing loose material from the hopper trailer and an apparatus for spreading loose material according to an embodiment of the invention.

FIGS. 1 to 4 show the general arrangement of a tractor 2, a hopper trailer 4, a belt conveyor system 6 and an apparatus 8 for spreading loose material, such as gravel. A tractor 2 is connected to the trailer 4 by a fifth wheel 10. Trailer 4 comprises a single hopper 11 supported between fifth wheel 10 and a rearward set of wheels 12 by supporting framework 14. Hopper 11 converges downwardly towards two rectangular openings 16 and 18. Openings 16 and 18 are separated by an upwardly pointed divider 20 which assures that all the material in the hopper 4 is directed towards either opening 16 or opening 18 as hopper 11 is emptied. Belt conveyor system 6 consists of a belt conveyor 22 mounted below opening 16 and belt conveyor 24 mounted below opening 18. Both conveyor 22 and conveyor 24 extend outwardly from the right side 44 of trailer 4.

Apparatus 8 for spreading loose material distributed from hopper 11 by conveyors 22 and 24 is mounted between trailer 4 and a surface paved road surface 27 and shoulder 26. A frame 28 connects apparatus 8 with the trailer 4 between conveyor system 6 and rearward wheels 12.

Figure 3:
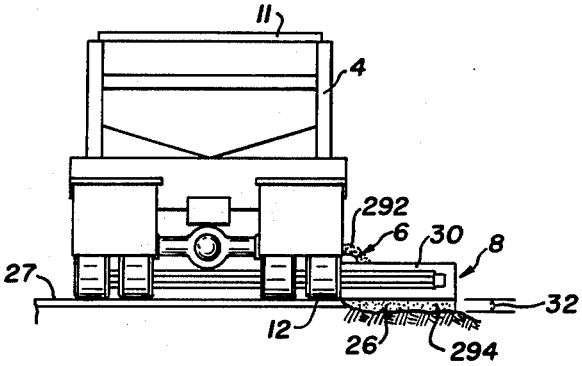
FIG. 3 is a rear elevational view of the trailer, conveyor system and apparatus for spreading loose material as shown in FIG. 1.
Figure 4:
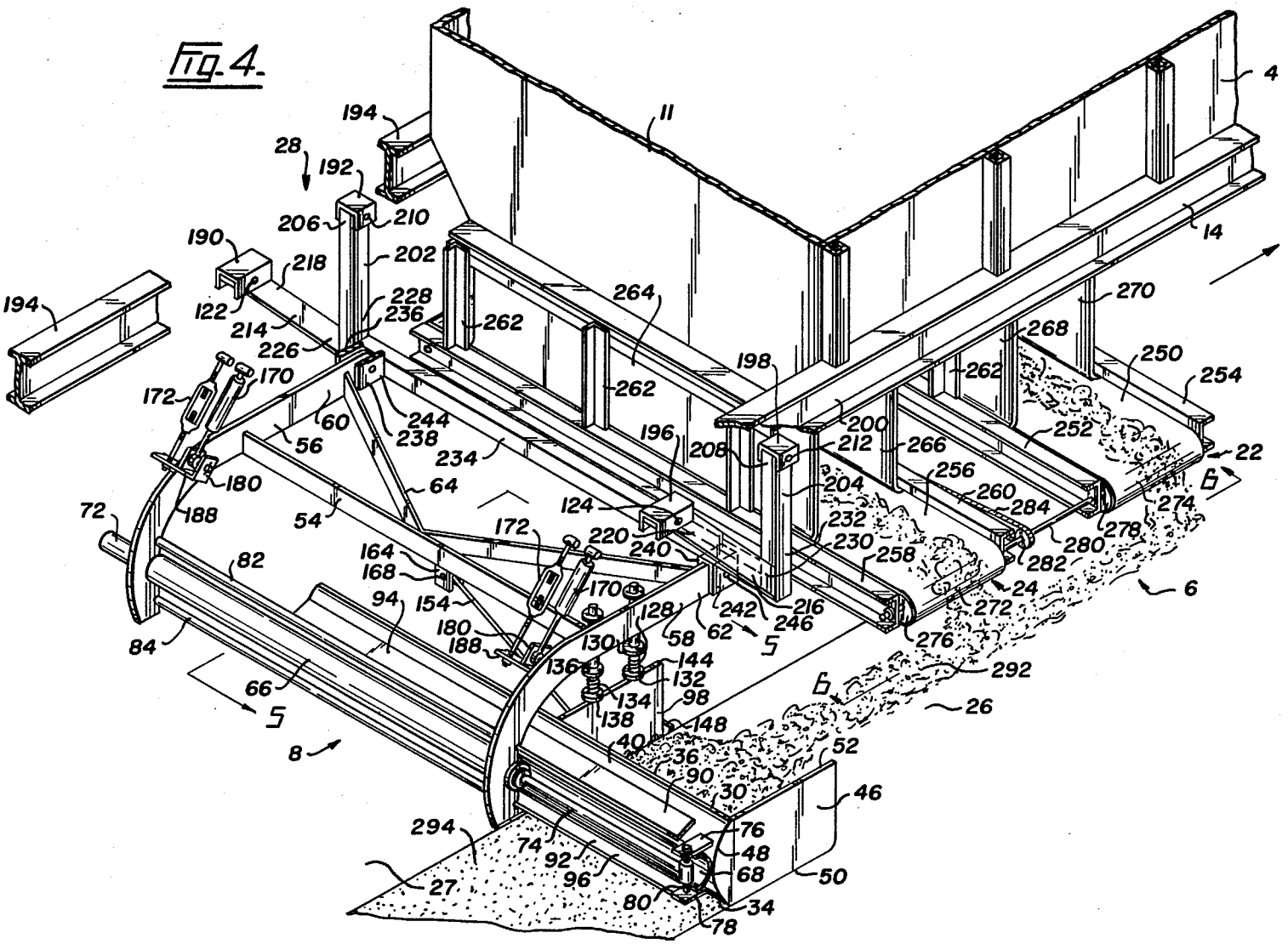
FIG. 4 is an isometric view of the apparatus for spreading loose material, conveyor system and trailer as shown in FIG. 1 with the rearward portion of the trailer broken away.

Referring to FIGS. 4 and 5 the apparatus 8 is shown in more detail. Constructing throughout is generally of structural steel components and sheet plate with welded connections. Apparatus 8 includes an elongate material spreader or blade 30. Spreader 30 is positioned parallel to the surfaces 26 and 27 and is spaced above the shoulder 26 a distance 32 when in use, as shown in FIG. 3. The spreader 30 has a straight bottom edge 34, a top edge 36 parallel to the bottom edge 34, a front 38 and a back 40. The top edge 36, bottom edge 34, front 38 and back 40 define a blade with the front 38 concavely curved from the top edge 36 to the bottom edge 34. As seen best in FIGS. 2, spreader 30 is perpendicular to the longitudinal centre line 42 of trailer 4 and, in the operational position shown, extends outwardly from right side 44 of trailer 4. A first material retainer 46 is connected to end 48 of spreader 30 distal trailer 4. First retainer 46 extends forwardly and perpendicularly from the front 38 of spreader 30. Retainer 46 extends from the bottom edge 34 to the top edge 36 of spreader 30. Retainer 46 comprises a flat rectangular plate with a straight bottom edge 50 and a straight top edge 52, both parallel to shoulder 26.

Apparatus 8 also includes a frame 54. Frame 54 includes two spaced-apart members 56 and 58 extending from adjacent surfaces 26 and 27 and, for the position of spreader 30 shown, member 58 extends from bottom edge 34 of spreader 30. Both member 56 and member 58 extend upwardly, curve forwardly and extend forwardly to ends 60 and 62 respectively. Members 56 and 58 both comprise flat steel plate. Members 56 and 58 are interconnected by cross bracing 64 and by longitudinally split, half tubular section 66. Section 66 is parallel to surface 27 and spreader 30 and is concavely curved towards spreader 30. A second longitudinally split, half tubular section 68 is connected to the back 40 of spreader 30. Section 68 is concavely curved towards section 66 to form a cylindrical opening 70 therebetween. An hydraulic cylinder 72 interconnects members 56 and 58 between the back 40 of spreader 30 and section 66 and is within cylindrical opening 70. Cylinder 72 has a piston rod 74 connected to spreader 30 by apertured lugs 76 and 78 and pin 80 therebetween. Tubular sections 82 and 84 are connected between members 56 and 58, above and below section 66 respectively. As seen in FIG. 5, sections 82 and 84 are provided with longitudinal slots 86 and 88 opening towards spreader 30. Rods 90 and 92 are slidably located within sections 82 and 84 respectively. Rods 90 and 92 extend the length of spreader 30 and are connected to spreader 30 by flat flanges 94 and 96 passing through slots 86 and 88. Tubular sections 82 and 84, rods 90 and 92 and flanges 94 and 96 provide means slidably connecting spreader 30 and frame 54 for movement of spreader 30 generally along the spreader and parallel to surface 27 and shoulder 26.

The apparatus 8 is also provided with a second material retainer 98. Retainer 98 extends forwardly and perpendicularly from the front 38 of the spreader 30 and extends from the top edge 36 to the bottom edge 34. Second retainer 98 comprises a generally flat plate parallel to the first retainer 46. Vertically oriented sleeves 100 and 102 are welded in spaced-apart relationship on member 58 above second retainer 98. Shafts 104 and 106 pass vertically through sleeves 100 and 102 and are welded at their bottom ends 108 and 110 to second retainer 98. At the top end 112 of shaft 104, a washer 116 is retained between nuts 118 and 120 threadedly engaged to shaft 104. Similarly, nuts 122 and 124 are threadedly engaged near the upper end 114 of shaft 106 and washer 126 is retained between nuts 122 and 124. Coil spring 128 is located between sleeve 100 and second retainer 98. Washer 130 is located between sleeve 100 and spring 128 and washer 132 is located between spring 128 and spreader 98. Similarly, coil spring 134 is located between sleeve 102 and second retainer 98. Washer 136 is located between sleeve 102 and spring 134 and washer 138 is located between spring 134 and retainer 98.

A pair of wheels 140 and 142 are provided near the bottom edge 101 of second retainer 98 on the side 144 opposite first retainer 46. A skid 146 is located along the bottom 101 of second retainer 98 and has an upwardly curving forward portion 148. Skid 146 is connected to the bottom 101 of second retainer 98 by bolts 150 and 152. Strut 154 is connected to second retainer 98 by lugs 156 and 158 and by nut and bolt set 160. Strut 154 is connected to cross bracing 64 by lugs 162 and 164 welded to the cross bracing 64 and by nut and bolt set 168.

The apparatus 8 is also provided with means for raising the apparatus towards the trailer 4 and away from the surface 27 and shoulder 26, and for lowering the apparatus towards the surfaces. This means is provided by a pair of pneumatic cylinders 170 and a pair of turnbuckles 172. Two short angle sections 174 are welded to the trailer 4 above apparatus 8. A pin 176 connects each cylinder 170 to angle sections 174 at one end and a pins 178 at the other end of cylinders 170 connects them to spaced-apart pairs of lugs 180 welded to members 56 and 58 and plates 188 welded thereto. Likewise, pins 182 connect one end of turnbuckles 172 to angle sections 174. The other ends of turnbuckles 172 are threaded and provided with nuts 184. Turnbuckles 172 pass slidably through an aperture 186 in each plate 188 welded to members 56 and 58. Nuts 184 stop ends 191 of turnbuckles 172 from passing through apertures 186.

As mentioned, a frame 28 is provided for connecting apparatus 8 to trailer 4. Short channel sections 190 and 192 are welded to the bottom of I-beam section 194 of supporting framework 14. Likewise, short angle sections 196 and 198 are welded to I-beam section 200. Square, vertical tubular sections 202 and 204 are connected at their top ends 206 and 208 to channel sections 192 and 198 by pins 210 and 212. Similarly, inclined, square tubular sections 214 and 216 are connected at upper ends 218 and 220 to channel sections 190 and 196 by pins 122 and 124. Lower end 226 of tube 214 is welded to lower end 228 of tube 202. Similarly lower end 230 of tube 216 is welded to lower end 232 of tube 204. A square tubular section 234 runs parallel to spreader 30 and connects end 228 of tube 202 with end 232 of tube 204. Two vertical rectangular tabs 236 and 238 are welded to tube 234 in spaced-apart parallel relationship near ends 226 and 228 of tubes 214 and 202. Similarly, rectangular tabs 240 and 242 are welded to tube 234 near ends 230 and 232 of tubes 216 and 204. Pin 244 passes through apertures in tabs 236 and 238 and through forward end 60 of member 56. Similarly, pin 246 passes through apertures in tabs 240 and 242 and in forward end 62 of member 58. Pins 244 and 246 provide means for pivotally connecting the apparatus 8 to trailer 4 between the trailer 4 and the surfaces 26 and 27.

Conveyor system 6 provides means for distributing material, such as gravel, from hopper 11 of trailer 4 in front of spreader 30 between first retainer 46 and second retainer 98. Conveyor 22 comprises an endless belt 250 located between spaced-apart, parallel, horizontal channel sections 252 and 254. Likewise, conveyor 24 comprises an endless belt 256 between channels 258 and 260. A plurality of upwardly extending angle sections 262 connect channels 258, 260, 252 and 254 to trailer 4. A pair of rectangular rubber skirts 264 and 266 extend upwardly to trailer 4 from the sides of conveyor belt 256 along angle sections 262. Similarly, a pair of rubber skirts 268 and 270 extend upwardly to trailer 4 from the sides of conveyor belt 250 of conveyor 22. The ends 272 and 274 of conveyors 24 and 22 respectively, are provided with rollers 276 and 278 for belts 256 and 250. Rollers 276 and 278 are rotated by a single shaft 280 suitably journalled in channels 258, 260, 252 and 254. A sprocket 282 is connected to shaft 280 and a chain 284 engages therewith.

Referring to FIG. 6, a hydraulic motor 286 and a gear box 288 are mounted on channel 260. Chain 284 connects sprocket 282 with gear box 288. The opposite ends of conveyor 22 and 24 are provided with undriven rollers similar to rollers 278 and 276.

Figure 2:
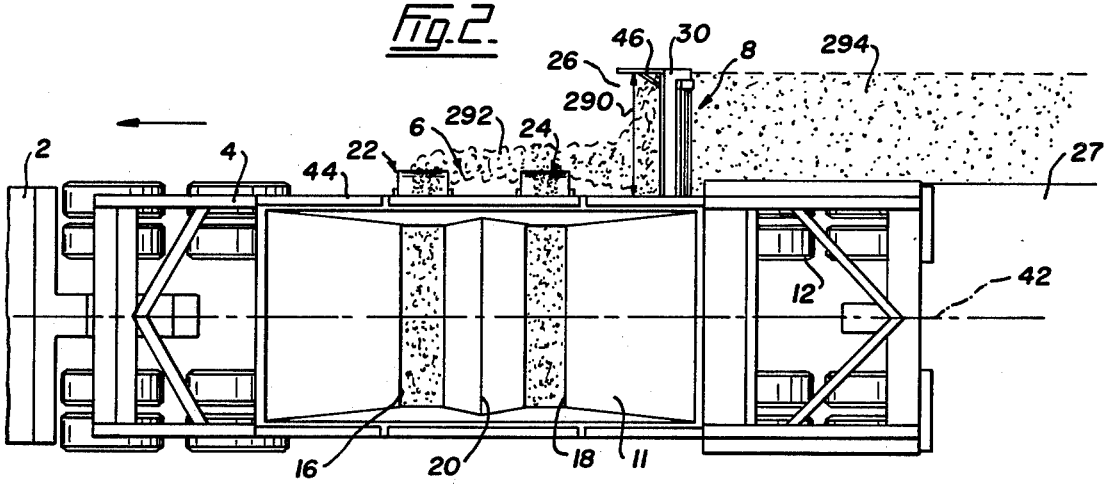
FIG. 2 is a top plan view of the trailer, tractor, conveyor system and apparatus as shown in FIG. 1.

The operation of the combination of the apparatus 8 for spreading loose material, such as gravel, the hopper trailer 4 and the conveyor system 6 for distributing the loose material to the front of the spreader 30 is shown best in FIGS. 2 to 4. In operation, the truck 2 moves the combination forwards in the direction indicated by the arrows. When the truck 2 and trailer 4 arrive at the job sight, the trailer 4 is positioned so its right side 44 is above the right edge 292 of the paved road surface 27. For transportation to the job site, pneumatic cylinders 170 have been activated to raise apparatus 8 upwardly about pins 244 and 246 to give adequate road clearance between the bottom of apparatus 8 and the road surface 27. At the job site, cylinders 170 are again activated to lower apparatus 8 to the position shown in FIGS. 1, 3, 4 and 6. Turnbuckles 172 provide a limit for the downward movement of apparatus 8.

During transportation, rod 74 is retracted into hydraulic cylinder 72 so spreader 30 is under hopper 11 and first retainer 46 is adjacent second retainer 98. At the job site, cylinder 72 is activated to extend spreader 30 laterally outwards from the right side 44 of trailer 4, positioning the first retainer 46 and the second retainer 98 a distance 290 apart along spreader 30 as shown in FIG. 2.

With hopper 11 full of gravel or other loose aggregate, conveyors 22 and 24 are activated by hydraulic motor 286 and moved towards their ends 274 and 272 respectively. This deposits an elongate pile of gravel 292 along the shoulder 26 of the road as the truck 2 moves fowards. As the spreader 30 contacts the pile of gravel 292, the gravel accumulates against spreader 30 and between first retainer 46 and second retainer 98. As the truck 2 moves forwards, the gravel is spread in an even strip 294 with a width equal to the distance 290 between first retainer 46 and second retainer 98 and with a thickness 32 equal to the distance between the bottom 34 of the spreader 30 and the road shoulder 26 as shown in FIG. 3. First retainer 46 operates to retain the gravel and prevent it from spreading outwards too far. Second retainer 98 is biased downwardly by springs 128 and 134, away from member 58 of frame 54 and towards roadway 27 and shoulder 26. This holds wheels 140 and 142 against the roadway 27 and skid 146 rides over the gravel and provides means for preventing the gravel from spilling onto the roadway 27.

The combination just described may be used for other purposes besides spreading gravel along the shoulder of a paved roadway. For example, it may be used for laying down the gravel subbase along a roadway when a curb is being constructed along the road. It can also be used to provide a gravel base for a concrete sidewalk. The combination is very well adapted for use with electronic leveling systems to provide an accurately level gravel base for many purposes.

What I claim is:

1. An apparatus for spreading loose material, such as gravel, onto a surface, comprising:

a trailer with at least one hopper for the material, a set of wheels near a rear end thereof and means for pivotally connecting the trailer to a tractor near a front end thereof;

an endless belt conveyor mounted below the hopper for distributing the material onto the surface to one side of the trailer;

a frame connected to the trailer beneath the trailer and extending rearwardly from near the conveyor;

an elongate spreader connected to the frame for positioning generally parallel to the surface a distance above at least a portion of the surface, the spreader being between the conveyor and the rear wheels of the trailer and having a bottom edge, a top, a front and a back and extending laterally from the trailer for spreading the material to the one side of the trailer;

a first material retainer connected to the spreader at an end thereof distal the trailer and extending generally forwardly from the front of the spreader;

a second material retainer connected to the frame, being spaced-apart from the first retainer and extending forwardly from near the front of the spreader; and means for positioning the first retainer and the second retainer a distance apart along the spreader so that, when the material is distributed from the hopper, the material is spread between the first retainer and the second retainer and between the bottom edge of the spreader and the surface as the trailer moves in a forward direction along the surface.

2. An apparatus as claimed in claim 1, the first and second retainers extending perpendicularly to the spreader, extending from near the top to near the bottom of the spreader and the means for positioning the retainers being adjustable so that the distance between the first and second retainers can be varied and the material can be spread in a strip with a width generally equal to the distance between the first and second retainers.

3. An apparatus as claimed in claim 1 or claim 2, wherein the first retainer comprises a flat plate connected to the spreader with a straight bottom edge for extending generally parallel to the surface.

4. An apparatus as claimed in claim 3, wherein the second retainer comprises a generally flat plate generally parallel to the first retainer and with a generally straight bottom for extending generally parallel to the surface.

5. An apparatus as claimed in claim 4, including resilient means biasing the second retainer downwardly away from the frame, the second retainer including a skid means near the bottom thereof.

6. An apparatus as claimed in claim 1, the spreader comprising a blade with a front concavely curved from the top to the bottom edge and having a top edge generally parallel to the bottom edge.

7. An apparatus as claimed in claim 1, comprising means for raising the apparatus towards the trailer and away from the surface and for lowering the apparatus towards the surface.

8. An apparatus as claimed in claim 7, the means for raising and lowering the apparatus comprising at least one fluid cylinder for connecting the frame to the trailer.

9. An apparatus as claimed in claim 2, wherein: the spreader comprises a blade with a front concavely curved from the top to the bottom edge; the first retainer comprises a flat plate having a generally straight bottom edge; the second retainer comprises a generally flat plate generally parallel to the first retainer and with a generally straight bottom edge, the second retainer being resiliently suspended from the frame in front of the spreader and biased away from the frame and including skid means near the bottom edge; the means for positioning the first and second retainers being adjustable so that the first and second retainers can be spaced apart a required distance for spreading material in a strip having a width generally equal to the required distance; and the apparatus comprises means for raising the blade and retainers towards the trailer and away from the surface and for lowering the blade and retainers towards the surface.

10. An apparatus as claimed in claim 9, the means for positioning comprising means slidably connecting the blade and the frame for movement of the blade generally along the blade and parallel to the surface.

11. An apparatus as claimed in claim 10, including a fluid cylinder connected to the blade for moving the blade and positioning the first and second retainers the required distance apart.

12. An apparatus as claimed in claim 9 or claim 11, wherein the frame comprises two spaced-apart members, at least said member extending from near the bottom of the blade, over the back of the blade and forwardly above the blade, and across bracing between the spaced apart members, means for pivotally connecting the apparatus to the trailer being near an end of each spaced-apart member distal the blade; wherein the means for raising and lowering comprises at least one fluid cylinder for connecting the frame to the hopper trailer; and wherein the cylinder for moving the blade is connected between the spaced apart members to the back of the blade.

* * * * *